United States Patent [19]

Bellettini et al.

[11] Patent Number: 5,056,786

[45] Date of Patent: Oct. 15, 1991

[54] TENNIS BALL RETRIEVER

[76] Inventors: Richard J. Bellettini, Victory/Vanowen St., Burbank, Calif. 91505; Arturo G. Bellettini, Washington & Dickinson St., Charleston, W. Va. 25311

[21] Appl. No.: 471,799

[22] Filed: Jan. 26, 1990

Related U.S. Application Data

[63] Continuation-in-part of Ser. No. 325,654, Mar. 20, 1989, abandoned.

[51] Int. Cl.[5] ..... A63B 61/00

[52] U.S. Cl. ..... 273/29 R; 273/58 K; 273/61 B; 273/73 R; 273/DIG. 30; 294/19.1

[58] Field of Search ..... 273/29 A, 26 B, 32 F, 273/58 R, 58 K, DIG. 30, 162 E, 61 B, 73 D; 294/19.1

[56] References Cited

U.S. PATENT DOCUMENTS

| | | | |
|---|---|---|---|
| 266,598 | 10/1882 | Alexander | 273/162 E |
| 4,029,316 | 6/1977 | Clarke | 273/DIG. 30 |
| 4,210,327 | 7/1980 | Schubert | 24/444 |
| 4,222,806 | 9/1980 | Parker | 273/61 B |
| 4,439,471 | 3/1984 | Lacoste | 273/61 B |
| 4,789,161 | 12/1988 | Waskelo | 273/DIG. 30 |
| 4,826,173 | 5/1989 | Brown | 273/DIG. 30 |
| 4,834,393 | 5/1989 | Feldi | 273/61 B |

FOREIGN PATENT DOCUMENTS

| | | | |
|---|---|---|---|
| 2533233 | 2/1977 | Fed. Rep. of Germany | 273/73 D |

*Primary Examiner*—Theatrice Brown

[57] ABSTRACT

A ball retrieval concept or idea using hook and mesh components in engaging relationship to one another. Application of the two components in any fashion to retrieve a tennis ball. One being a racket with a section of hook material attached at the butt of the handle. Secondly, fitting a covering of intermeshing material around a tennis ball. When the butt of the racket is put in contact with tennis ball having the mesh covering, the ball will fasten temporarily to the racket. This eliminates the problem of having to constantly stoop to pick up the ball.

5 Claims, 1 Drawing Sheet

TENNIS BALL RETRIEVER

This application is a continuation-in-part of pending prior application Ser. No. 325,654 filed on Mar. 20, 1989 (ABANDONED) of Richard J. Bellettini and Arturo G. Bellettini for the Tennis Ball Retriever.

BACKGROUND OF THE INVENTION

1. Field of the Invention

This invention relates to a system of retrieving tennis balls from the ground during a game. The components of such a system would be incorporated onto a tennis racket and tennis ball, eliminating the need for carrying any additional devices. The system should not in any way shape or form detract from the performance of the racket or the ball. Finally, when engagement of the ball to the racket has occured it should be easily detachable.

2. Prior Art

U.S. Pat. No. 4,210,327, 7/1980 Schubert. In FIG. 9, Item 348 a hooked fabric is attached to the end of the tennis racket. This system is very inefficient at picking up the ball because the hooked fabric is not compatible with the curly pile of the ball. U.S. Pat. No. 4,834,393, 5/1989 Feldi. In FIG. 3 a new revolutionary tennis ball covered with loop fastener is suggested to make the ball exterior properly compatible with hooked material. This idea, although novel, may be impractical since construction of a tennis ball with a modified loop exterior would be costly because of the change in materials of construction required by the tennis ball manufacturer.

SUMMARY OF THE INVENTION

The main problem that previously sited prior art has with the retrieval of a tennis ball is coming up with an inexpensive and more practical way of enhancing the engaging properties of hooked fabric. The most efficient, least expensive, and most practical resolution to this problem is to develop a secondary covering for a tennis ball, thus making the need for a ball constructed entirely of looped material on the exterior totally unnecessary. The secondary covering which should be as light as possible would have the following characteristics: meshed/interlaced natural or man-made fabric(i.e. cotton, nylon, etc.), close fitting, and optionally separable to the tennis ball. To reduce variations in tennis ball performance, the secondary covering should be constructed with interlacing fibers positioned so as to expose as much of the ball's original exterior as possible. This does not suggest that complete coverage of a tennis ball by the meshed material is ruled out. Now, by simply attaching a section of hook component fastener to the butt of the handle, by adhesive means, and making contact with the applied mesh covering the ball is easily retrieved without stooping. The retrieval action does not damage either the ball or the meshed covering if the latter is made of commercially available strong and resilient material.

DETAILED DESCRIPTION OF DRAWINGS

Figure 1:
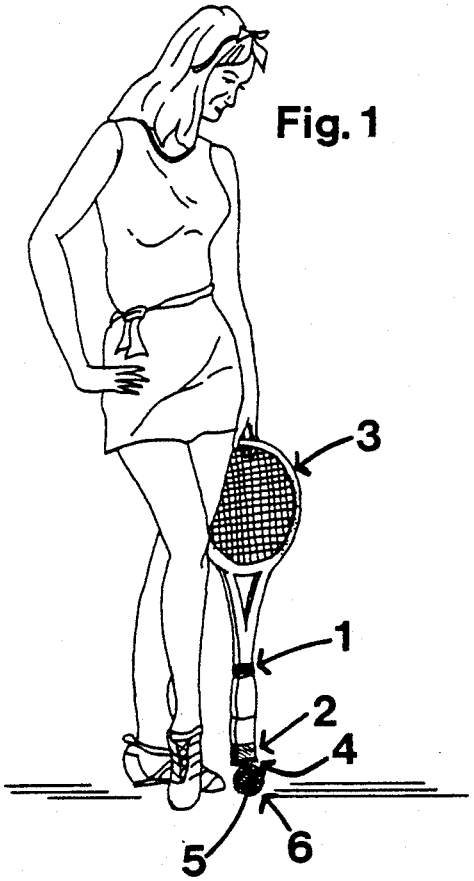
FIG. 1 is a fragmentary, perspective view illustrating the manner in which hook and mesh fastening means in accordance with the present invention is used.
Figure 2:
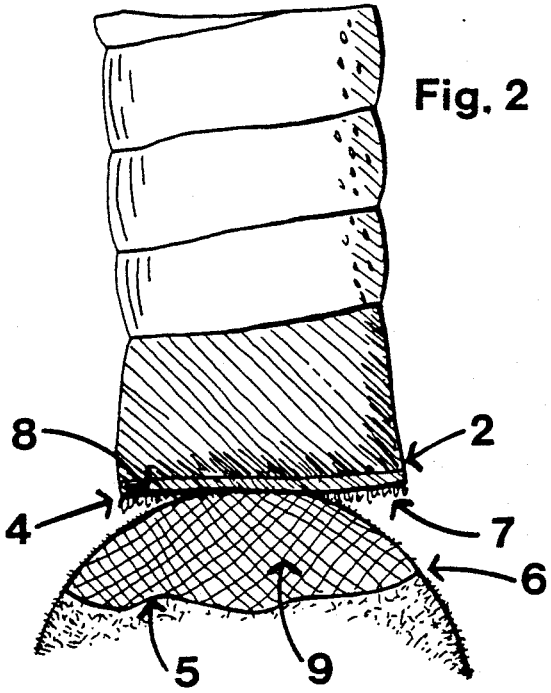
FIG. 2 is an enlarged view, partially in section, showing hook fabric affixed to the butt of the handle engaging with the meshed material of an applied secondary covering to a tennis ball.

The tennis racket 1 in FIG. 1 has a head 3 at one end thereof and a butt 2 at the opposite end thereof. A section of hook fabric 4, which constitutes the first half of the tennis ball retrieving system, is attached to the butt 2. The player holds the tennis racket 1 by the head 3 to allow the hook fabric 4 to come in contact with the secondary covering 5 about a tennis ball 6. The hook fabric 4 in FIG. 2 is attached to the butt 2 by an adhesive layer 8. The hooks 7 from the hook fabric 4 engage with the secondary covering 5 by first pushing between the meshed material 9 and the tennis ball 6 and then hooking on to the former as the tennis racket 1 is lifted. The whole process is initiated by the player touching the butt 2 to the tennis ball 6 as indicated in FIG. 1.

Figure 3:
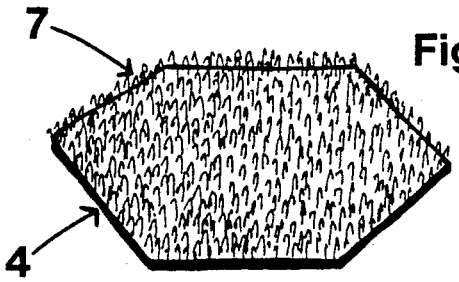
FIG. 3 is a sample of hook fastener.

The section of hook fabric 4 in FIG. 3 is made up of countless small hooks 7. The use of hook fabric 4 is better known for its relationship with looped material as in the Velcro hook and loop fastening system. The application of hook fabric 4 in the present invention differs from that of the Velcro system in that the engagement of hook to mesh is functionally unique.

Figure 4:
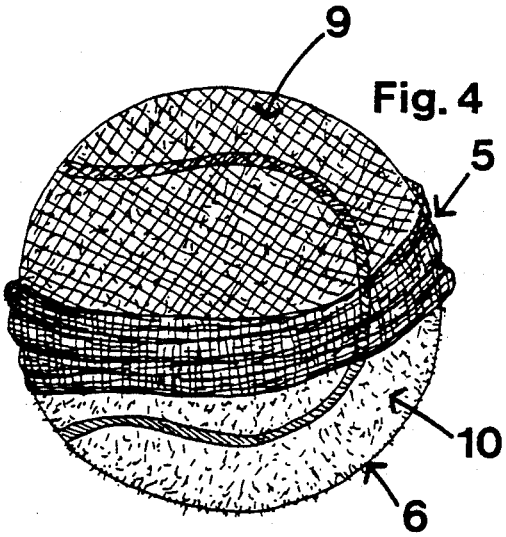
FIG. 4 is a perspective view of an applied secondary covering broken away to expose the tennis ball exterior.
Figure 5:
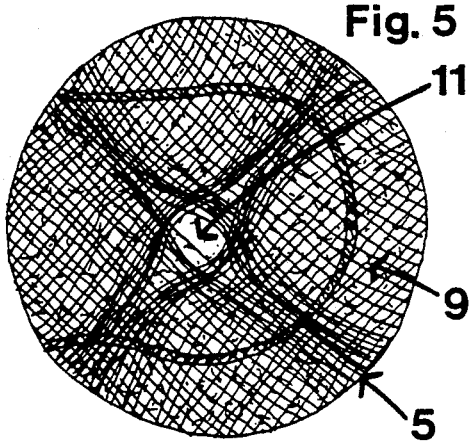
FIG. 5 is a perspective view of a secondary covering to a tennis ball.

The secondary covering 5 in FIG. 4 is woven with mesh material 9 to compressably surround the exterior of a tennis ball 6. A good example of such a mesh material 9 that could be employed is that of nylon stockings. The secondary covering 5 may be constructed with mesh material 9 that exposes sections of the tennis ball exterior. This would help to eliminate problems involved with a loss of friction between the tennis ball 6 and the court surface. The secondary covering 5 in FIG. 5 may be provided with an opening 11 that would allow its application to a tennis ball 6 by a player. The way in which the mesh material 9 is to be constructed to fit over a tennis ball 6, in this or any other form, is taken to be well understood by those skilled in the art.

While the above description contains many specificities, these should not be construed as limitations on the scope of the invention, but rather as an exemplification of one preferred embodiment thereof. Many other variations are possible, for example the hook fabric might be placed about the periphery of the head of the racket. The ball would then engage with the head rather than the butt of the racket. With respect to the nature of the hook fastening means, one could substitute metallic hooks or "teeth" for hook fabric and set it into a recessed floor attached to the butt of the tennis racket. Accordingly, the scope of the invention should be determined not by the embodiment illustrated, but by the claims and their legal equivalents.

We claim:

1. A tennis ball retrieval system comprising; the combination of a tennis racket, a tennis ball, a strip of hook fabric and a mesh fabric of move stocking material, said tennis racket having a ball contact head portion and an elongated handle attached to said head portion at one of its ends, said handle having at its other end a substantially planar surface perpendicular to the longitudinal axis thereof, said hook fabric being attached to said planar surface, said stocking material being attached to the outer surface of said ball, whereby when said hook fabric is engaged with said stocking material said ball will be attached to said racket handle.

2. The tennis ball retrieval system of claim 1 wherein, said stocking material is nylon.

3. The tennis ball retrieval system of claim 2 wherein, said stocking material is attached only to a portion of the outer surface of said ball.

4. The tennis ball retrieval system of claim 2 wherein, said stocking material is attached to cover the entire surface of said ball.

5. The tennis ball retrieval system of claim 5, wherein, said stocking material is pre-formed to conform to the surface of said tennis ball, said preform having an opening less than the diameter of said ball whereby said opening is stretched for the insertion of said stocking material over the surface of said ball.

* * * * *